US011359409B2

(12) United States Patent
He et al.

(10) Patent No.: US 11,359,409 B2
(45) Date of Patent: Jun. 14, 2022

(54) PLAYPEN DOOR

(71) Applicant: ZHONGSHAN EKAR UPING HOUSEWARE CO., LTD., Guangdong (CN)

(72) Inventors: Jianghua He, Guangdong (CN); Guozhu Feng, Guangdong (CN); Xinliang Ouyang, Guangdong (CN)

(73) Assignee: ZHONGSHAN EKAR UPING HOUSEWARE CO., LTD., Guangdong (CN)

( * ) Notice: Subject to any disclaimer, the term of this patent is extended or adjusted under 35 U.S.C. 154(b) by 149 days.

(21) Appl. No.: 16/959,265

(22) PCT Filed: May 21, 2020

(86) PCT No.: PCT/CN2020/091440
§ 371 (c)(1),
(2) Date: Aug. 11, 2020

(87) PCT Pub. No.: WO2021/232326
PCT Pub. Date: Nov. 25, 2021

(65) Prior Publication Data

US 2021/0348420 A1 Nov. 11, 2021

(30) Foreign Application Priority Data

May 11, 2020 (CN) ..... 202010393067.1

(51) Int. Cl.
*G08B 21/00* (2006.01)
*E05B 45/06* (2006.01)

(52) U.S. Cl.
CPC ..... *E05B 45/06* (2013.01); *E05B 2045/0665* (2013.01); *E05Y 2201/46* (2013.01);
(Continued)

(58) Field of Classification Search
CPC ..... E05B 45/06; E05B 2045/0665; E05B 65/0007; E05B 65/0014; E05B 47/0001;
(Continued)

(56) References Cited

U.S. PATENT DOCUMENTS 10,733,822 B1 * 8/2020 Roberts ..... E05B 39/04
2002/0194786 A1 * 12/2002 Hincher, Sr. ..... E06B 9/04 49/463

(Continued)

FOREIGN PATENT DOCUMENTS

CN 108035669 A 5/2018
CN 208240172 U 12/2018

(Continued)

OTHER PUBLICATIONS

International Search Report (translation) dated Jan. 27, 2021 from corresponding International Patent Application No. PCT/CN2020/091440; 2 pages.

*Primary Examiner* — Mark S Rushing
(74) *Attorney, Agent, or Firm* — Berenato & White, LLC

(57) ABSTRACT

A playpen door, including a door frame; a door body movably mounted on the door frame; and a detection assembly mounted on the door frame and the door body and configured to detect open or closed state of the door body. The door body is hinged to the door frame. A locking assembly is arranged between the door body and the door frame. The locking assembly may be opened by a switch. The detection assembly is mounted away from a position where the door body is hinged to the door frame. When the door body rotates relative to the door frame, the detection assembly may be triggered, at which time the door body may be sensed to be open. When the door body returns to the
(Continued)

closed position again after opening, the detection assembly may be triggered, at which time the door body may be sensed to be closed.

15 Claims, 5 Drawing Sheets

(52) U.S. Cl.
CPC ... *E05Y 2400/324* (2013.01); *E05Y 2400/326* (2013.01); *E05Y 2400/445* (2013.01)

(58) Field of Classification Search
CPC ..... E05B 2047/0058; E05Y 2201/46; E05Y 2400/324; E05Y 2400/326; E05Y 2400/445; E06B 9/04; E06B 9/02; E06B 2009/002; E06B 11/02
USPC ..... 340/540
See application file for complete search history.

(56) References Cited

U.S. PATENT DOCUMENTS

| | | | | |
|---|---|---|---|---|
| 2005/0028947 | A1* | 2/2005 | Waldman | E05B 65/0014 160/215 |
| 2012/0169493 | A1* | 7/2012 | Hsieh | G08B 21/24 340/540 |
| 2017/0350165 | A1* | 12/2017 | Schort | E05B 65/0007 |
| 2017/0356238 | A1 | 12/2017 | Gitman | |
| 2018/0259595 | A1* | 9/2018 | Smith | E05B 17/203 |
| 2018/0298642 | A1* | 10/2018 | Tagtow | E05B 63/0056 |

FOREIGN PATENT DOCUMENTS

| | | | |
|---|---|---|---|
| CN | 109707239 | A | 5/2019 |
| CN | 209924864 | U | 1/2020 |
| CN | 110761690 | A | 2/2020 |
| CN | 111577097 | A | 8/2020 |

* cited by examiner

PLAYPEN DOOR

CROSS-REFERENCE TO RELATED APPLICATIONS AND CLAIM TO PRIORITY

This application is a national stage application of International Application No. PCT/CN2020/091440 filed May 21, 2020, which claims priority to Chinese Patent Application No. 202010393067.1 filed May 11, 2020, the disclosures of which are incorporated herein by reference and to which priority is claimed.

FIELD OF THE INVENTION

The disclosure relates to the technical field of a playpen device, and in particular to a playpen door.

BACKGROUND OF THE INVENTION

When a caregiver is unable to always look after an infant or pet for various reasons, it is necessary to provide a safe environment for the infant or pet to play. In this case, people usually use a playpen to enclose a safe area. The playpen is generally provided with a door for easy entry and exit. The infant can open the playpen door after he/she grows up a little, or the pet can open the playpen door after a long period of observation and learning. The caregiver may be unaware of this situation in time. As a result, the infant or pet goes out of the playpen without the caregiver's knowledge, which is unable to realize the infant/pet-caring effect.

SUMMARY OF THE INVENTION

To at least solve one of the technical problems in the prior art, a playpen door is provided according to the disclosure which can detect an open or closed state of the door body in real time.

In an aspect of the disclosure, a playpen door is provided, including a door frame; a door body movably mounted on the door frame; and a detection assembly mounted on the door frame and the door body and configured to detect open or closed state of the door body.

In some embodiments of the disclosure, the detection assembly includes a first mounting shell, a magnet and a sensing unit configured to detect a position of the magnet, one of the magnet and the first mounting shell is mounted on the door frame and the other one is mounted on the door body, the first mounting shell has a mounting chamber in which the sensing unit is mounted.

In some embodiments of the disclosure, the detection assembly further includes a warning light, which is mounted in a first through hole formed in an upper end of the mounting chamber and electrically connected to the sensing unit.

In some embodiments of the disclosure, the detection assembly further includes a buzzer electrically connected to the sensing unit, and an inner sidewall of the mounting chamber is formed with a second through hole corresponding to the buzzer.

In some embodiments of the disclosure, the detection assembly further includes a wireless communication module which is mounted in the mounting chamber and electrically connected to the sensing unit.

In some embodiments of the disclosure, the mounting chamber is located in a lower portion of the first mounting shell, a switch is arranged on a sidewall of the mounting chamber, an upper portion of the first mounting shell is divided into a battery compartment and a wiring compartment by a spacer that is arranged vertically, the battery compartment is opened or closed by a compartment door, and the first through hole is located in an upper portion of the wiring compartment.

In some embodiments of the disclosure, a mounting groove is formed on an outer sidewall of the first mounting shell, the mounting groove has a width matched with a thickness of the door body, a third through hole is formed in both sidewalls of the mounting groove, a positioning block is arranged in the mounting groove, a fourth through hole is formed in the positioning block, and a bolt passes through the third through hole and the fourth through hole.

In some embodiments of the disclosure, the positioning block is elastic and has a flat surface fitted with the door body.

In some embodiments of the disclosure, the magnet is mounted in a second mounting shell, a slot is formed in the second mounting shell, the slot is clamped with a vertical sidewall of the door frame, and a boss is arranged on the vertical sidewall of the door frame below the second mounting shell; and a lower portion of the boss is connected to a bottom sidewall of the door frame.

In some embodiments of the disclosure, the detection assembly includes a light generator, a light receiver and a reflecting surface, the light generator and the light receiver are arranged on the door body, and the reflecting surface is arranged on the door frame.

Any one of the above technical solutions has at least the following beneficial technical effects: the opening/closing of the door body can be obtained in real time by a detection assembly which is provided to detect the open/closed state of the door body. The caregiver may be aware of the opening/closing of the door body by the infant or pet and deal with this situation in time.

BRIEF DESCRIPTION OF THE DRAWINGS

The disclosure will be further described below with reference to embodiments in combination with the accompanying drawings, in which.

LIST OF REFERENCE NUMERALS

Figure 1:
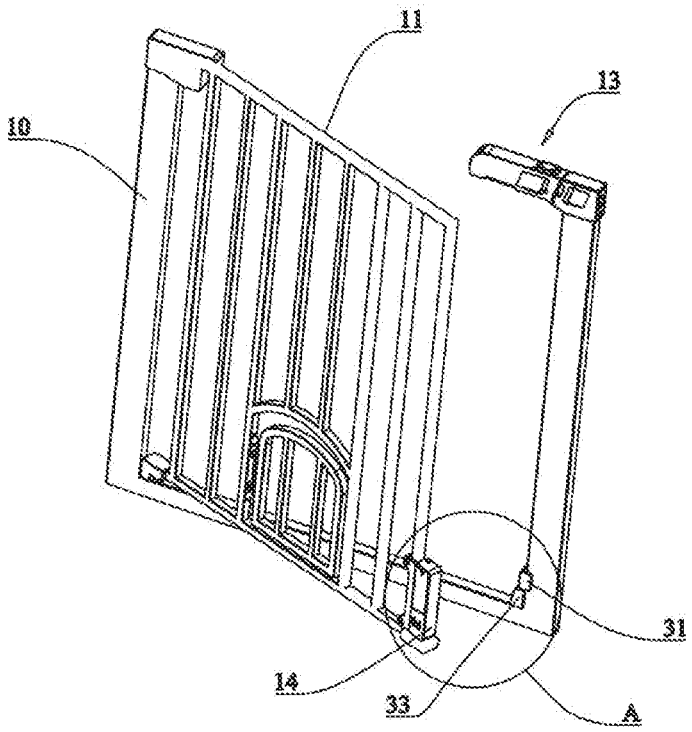
FIG. 1 is a schematic view of a playpen door in an open state according to an embodiment of the disclosure.

10: door frame; 11: door body; 12: detection assembly; 13: locking assembly; 14: first mounting shell; 15: magnet; 16: sensing unit; 17: mounting chamber; 18: warning light; 19: first through hole; 20: second through hole; 21: switch; 22: spacer; 23: battery compartment; 24: wiring compartment; 25: compartment door; 26: mounting groove; 27: third through hole; 28: positioning block; 29: fourth through hole; 30: flat surface; 31: second mounting shell; 32: slot; and 33: boss.

DETAILED DESCRIPTION OF THE PREFERRED EMBODIMENT(S)

This section will describe the specific embodiments of the disclosure in detail. The preferred embodiments of the disclosure are shown in the drawings. The drawings are provided to supplement, with graphics, the description of the text part of the specification, so that people can intuitively and visually understand each technical feature and overall technical solution of the disclosure, and should not be understood as any limitations to the protection scope of the disclosure.

In the description of the disclosure, it should be understood that orientations or locations indicated by terms "upper", "low", "front", "rear", "left" and "right" are the orientations or locations illustrated on the basis of the accompanying drawings, merely used for conveniently describing the disclosure and simplifying the description and not intended to indicate or imply that the device or element indicated must have the specific orientations or must be constructed and operated in the specific orientations, thus shall not be interpreted as any limitations to the disclosure.

In the description of the disclosure, "several" means "one or more"; "a plurality of" means "more than two"; "greater than", "less than", "exceeding" or the like should be considered as excluding the number; and "above", "below", "within" or the like should be considered as including the number. Terms such as "first" and "second", if mentioned, are used only for the purpose of distinguishing the technical features, and should not be understood as indicating or implying relative importance or implicitly indicating the number of the indicated technical features or impliedly indicating the order of the indicated technical features.

In the description of the disclosure, unless otherwise clearly defined, terms such as "arrange", "mount", "connect" should be understood in a broad sense, and those skilled in the art can reasonably determine the specific meaning of the above terms in the disclosure in conjunction with the specific content of the technical solution.

With reference to FIGS. 1-5, there is provided a playpen door according to an embodiment of the disclosure, including a door frame 10, a door body 11 and a detection assembly 12. The door body 11 is movably mounted on the door frame 10. The detection assembly 12 is mounted on the door frame 10 and the door body 11 and configured to detect the open/closed state of the door body 11. In this embodiment, the door body 11 is hinged to the door frame 10. A locking assembly 13 is arranged between the door body 11 and the door frame 10. The locking assembly 13 may be opened by a switch. The locking assembly 13 may be a locking assembly in the prior art and will not be repeated here. The detection assembly 12 is mounted away from a position where the door body 11 is hinged to the door frame 10. When the door body 11 rotates relative to the door frame 10, the detection assembly 12 may be triggered, at which time the door body 11 may be sensed to be open. When the door body 11 returns to the closed position again after opening, the detection assembly 12 may be triggered, at which time the door body 11 may be sensed to be closed. Thus, in this embodiment, by the arrangement of the detection assembly 12, the open/closed state of the door body 11 is detected in real time. The caregiver may be aware of the opening/closing of the door body 11 by the infant or pet and deal with this situation in time.

Of course, it may be understood by those skilled in the art that the door body 11 may also be movably mounted on the door frame 10 in other structures. For example, the door body 11 may be movably mounted on the door frame 10 in a sliding manner, and in this case, the door body 11 may also be opened/closed.

Figure 3:
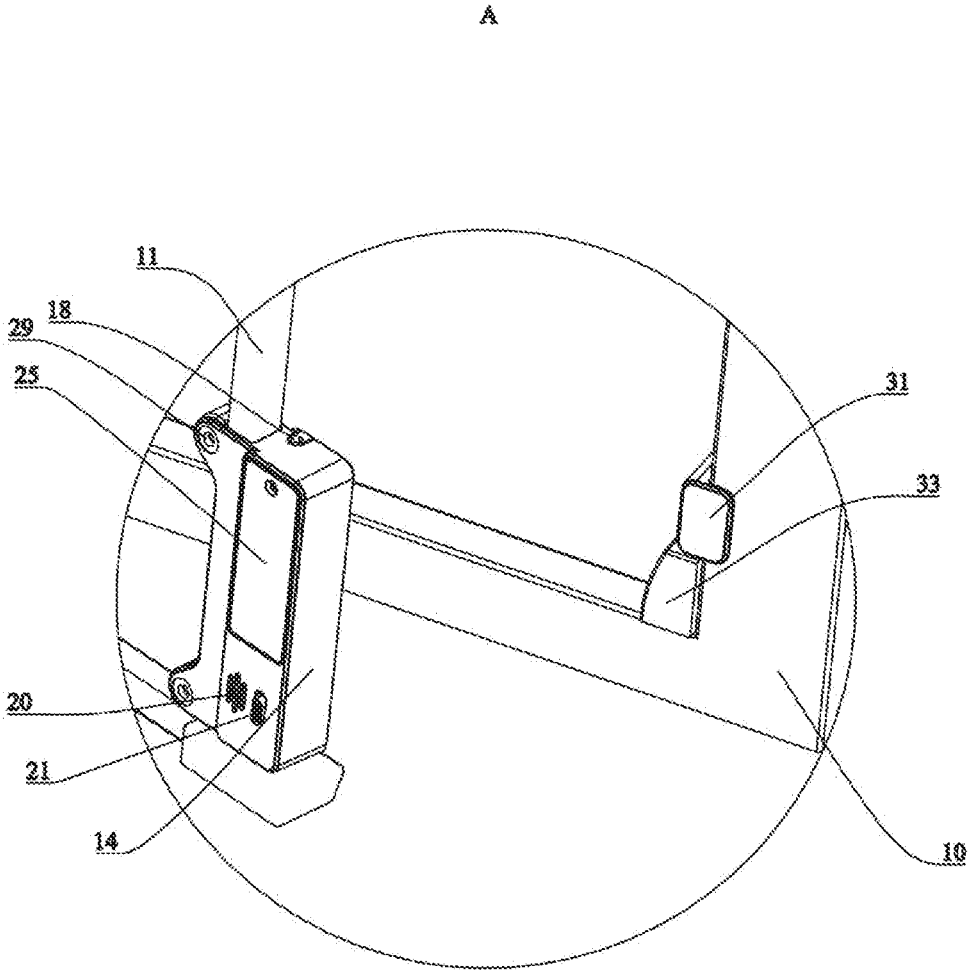
FIG. 3 is a partially enlarged view of part A of FIG. 1.
Figure 4:
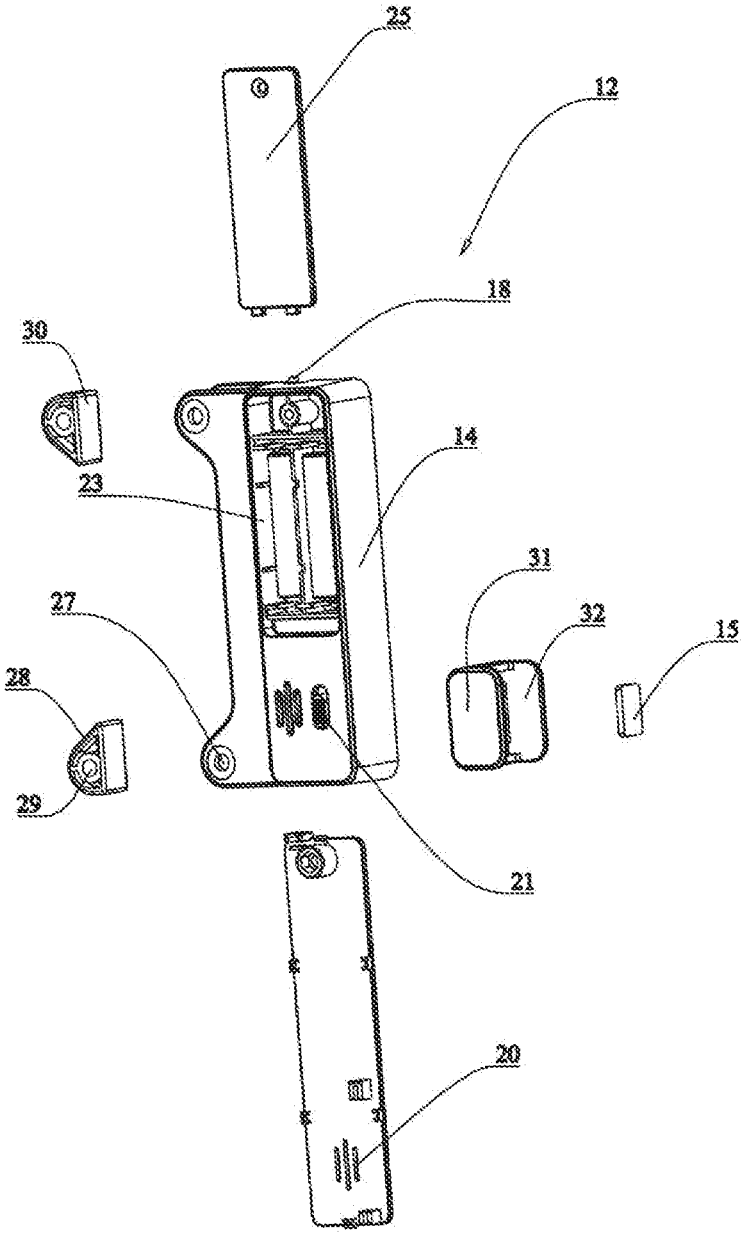
FIG. 4 is a first exploded view of a detection assembly according to an embodiment of the disclosure.
Figure 5:
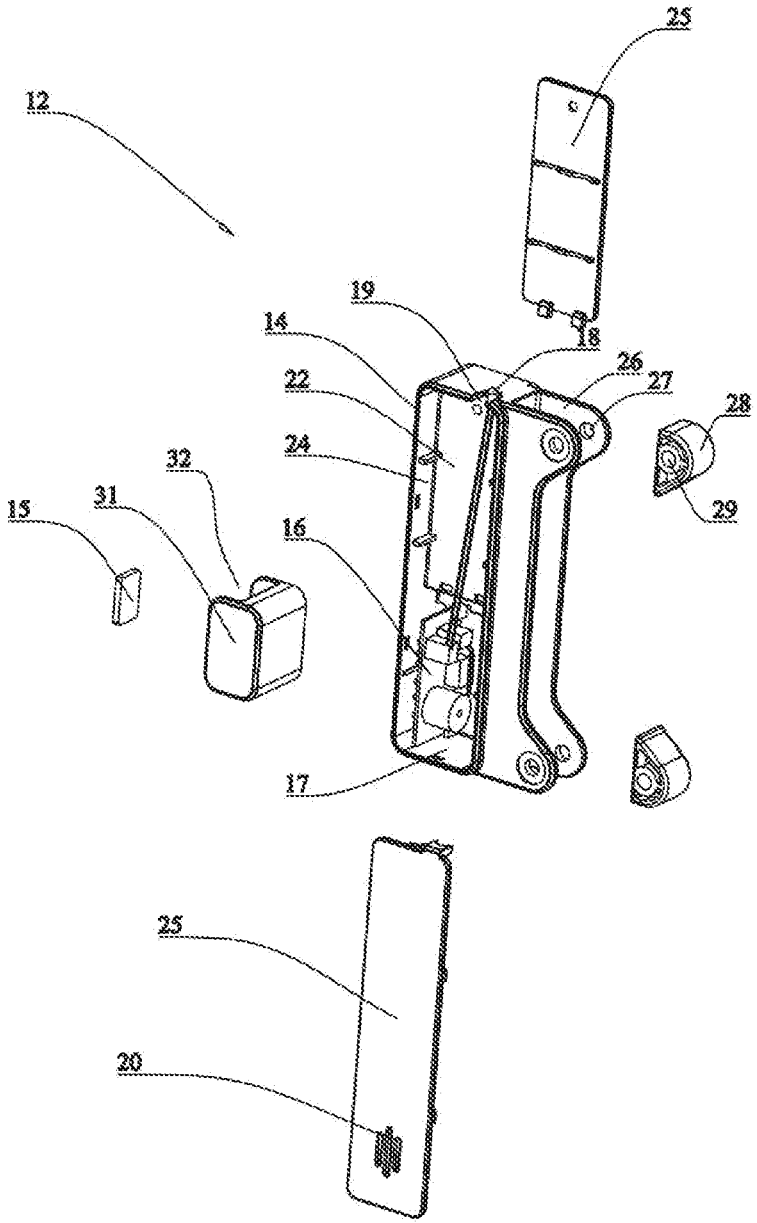
FIG. 5 is a second exploded view of the detection assembly according to an embodiment of the disclosure.

As shown in FIGS. 1, 3 and 4, in some embodiments of the disclosure, the detection assembly 12 includes a first mounting shell 14, a magnet 15, and a sensing unit 16 configured to detect a position of the magnet 15. The magnet 15 is arranged on the door frame 10, and the first mounting shell 14 is arranged on the door body 11. The first mounting shell 14 has a mounting chamber 17 in which the sensing unit 16 is mounted. The sensing unit 16 may be implemented by a Hall element. When the door body 11 rotates away from the door frame 10, there is a change in distance between the Hall element and the magnet 15, causing a change in current within the Hall element, and a signal is sent to indicate that the door body 11 is in the open state. When the door body 11 returns to the closed position again, the current within the Hall element changes and a signal is sent to indicate that the door body 11 is in the closed state.

Of course, it may be understood by those skilled in the art that the mounting positions of the first mounting shell 14 and the magnet 15 are not limited to the above-mentioned embodiments, and there may be other implementations. For example, the first mounting shell 14 may be arranged on the door frame 10, and the magnet 15 may be arranged on the door body 11. This embodiment can also realize the purpose of detecting the state of the door body 11.

As shown in FIGS. 3 and 4, when the door body 11 is opened, information indicative of the opening of the door body 11 needs to be transmitted to the caregiver in time. For this reason, in some embodiments of the disclosure, the detection assembly 12 further includes a warning light 18, a first through hole 19 is formed in an upper end of the mounting chamber 17, and the warning light 18 is mounted in the first through hole 19 and electrically connected to the sensing unit 16. The exposure of the warning light 18 from the mounting chamber 17 is convenient for the caregiver to check in time. The warning light 18 may be implemented by a flickering red light. When the door body 11 is opened, the sensing unit 16 sends a signal to control the warning light 18 to turn on. The warning light 18 is connected to a power supply which may be a dry battery or button battery.

As shown in FIGS. 3 and 4, when the door body 11 is opened, information indicative of the opening of the door body 11 needs to be transmitted to the caregiver in time. For this reason, in some embodiments of the disclosure, the detection assembly 12 further includes a buzzer electrically connected to the sensing unit 16, and an inner sidewall of the mounting chamber 17 is formed with a second through hole 20 corresponding to the buzzer. When the door body 11 is opened, the sensing unit 16 sends a signal to control the buzzer to turn on. The buzzer is connected to a power supply which may be a dry battery or button battery. The second through hole 20 can reduce the attenuation of sound made by the buzzer during the propagation, thereby avoiding waste of energy.

The buzzer may be replaced by a speaker in which sound may be pre-recorded. For example, the warning of the caregiver may be pre-recorded. When the door body 11 is opened, the speaker plays the warning, by which the infant or pet may go back to the playpen in time, thereby realizing the infant/pet-caring effect.

When the door body 11 is opened, information indicative of the opening of the door body 11 needs to be transmitted to the caregiver in time. For this reason, in some embodiments of the disclosure, the detection assembly 12 further includes a wireless communication module which is mounted in the mounting chamber 17 and electrically connected to the sensing unit 16. The wireless communication module can communicate with the caregiver's mobile phone. When the door body 11 is opened, the sensing unit 16 sends a signal to control the wireless communication module to operate. The wireless communication module sends a signal to the caregiver's mobile phone, to warn the caregiver of the opening of the door body 11. The wireless communication module is connected to a power supply which may be a dry battery or button battery.

It may be understood by those skilled in the art that the warning light 18, the buzzer, the speaker, and the wireless communication module may all exist in an embodiment of the disclosure, and may also exist alone or in a combination of any two thereof or in a combination of any three thereof, depending upon the actual use environment. For example, if the use environment is noisy, the buzzer and speaker may be omitted; and if the use environment is quite bright, the warning light 18 may be omitted; and so forth.

As shown in FIGS. 3 and 4, in some embodiments of the disclosure, the mounting chamber 17 is located in a lower portion of the first mounting shell 14, a switch 21 is arranged on the sidewall of the mounting chamber 17, an upper portion of the first mounting shell 14 is divided into a battery compartment 23 and a wiring compartment 24 by a spacer 22 that is arranged vertically, the battery compartment 23 is opened/closed by a compartment door 25, and the first through hole 19 is located in an upper portion of the wiring compartment 24. The battery compartment 23 is provided to receive a battery which may be a dry battery or button battery or rechargeable battery or the like. The switch 21 is configured to control the battery to supply power. The whole detection assembly 12 stops operating when the switch 21 is opened. It is necessary to close the switch 21 when monitoring is required. The spacer 22 can reasonably divide and thus make full use of the space in the mounting chamber 17, thereby reducing the volume of the first mounting shell 14. The formation of the first through hole 19 in the upper portion facilitates the caregiver to check the warning light 18. The overall structure design is simple, ingenious and highly practical.

Figure 2:
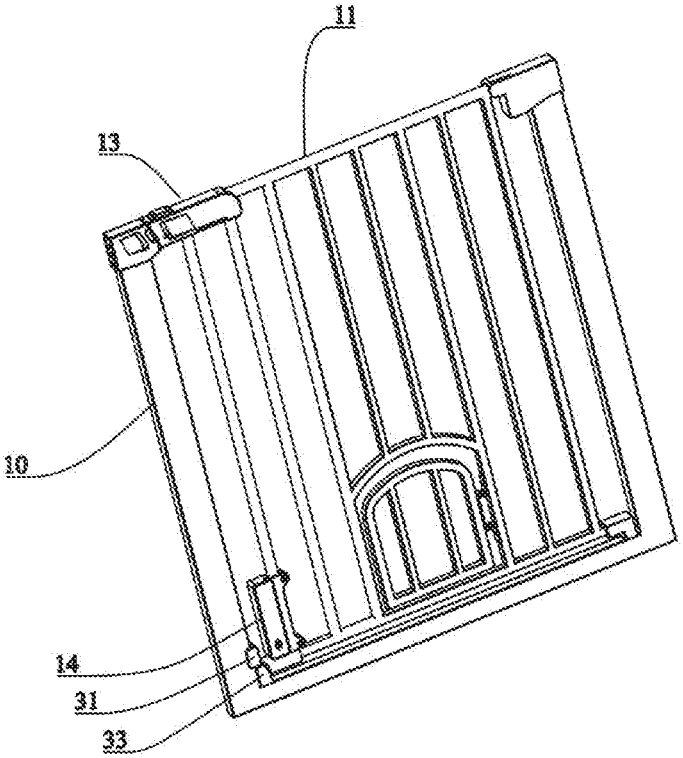
FIG. 2 is a schematic view of the playpen door in a closed state according to an embodiment of the disclosure.

As shown in FIGS. 2 and 4, in some embodiments of the disclosure, a mounting groove 26 is formed on an outer sidewall of the first mounting shell 14. The mounting groove 26 has a width matched with the thickness of the door body 11. A third through hole 27 is formed in both sidewalls of the mounting groove 26. A positioning block 28 is arranged in the mounting groove 26. A fourth through hole 29 is formed in the positioning block 28. A bolt passes through the third through hole 27 and the fourth through hole 29. The door body 11 generally has a plurality of vertical bars, and the mounting groove 26 is used for cooperating with the vertical bars. After the mounting groove 26 is clamped with the vertical bars, it is fastened to the vertical bars by the positioning block 28 and then fixed by the bolt. In order to increase the structural strength of the connection, in some embodiments of the disclosure, the positioning block 28 is elastic and has a flat surface 30 fitted with the door body 11. In this way, the vertical bars may be squeezed by the elastic positioning block 28 to achieve stable connection between the mounting groove 26 and the vertical bars. In some embodiments, the positioning block 28 may be made of rubber material. The flat surface 30 can increase the contact area between the positioning block 28 and the vertical bars, thus further increasing the connection strength.

As shown in FIGS. 3 and 4, in some embodiments of the disclosure, the magnet 15 is mounted in a second mounting shell 31. A slot 32 is formed in the second mounting shell 31 and is clamped with a vertical sidewall of the door frame 10. A boss 33 is arranged on the vertical sidewall of the door frame 10 below the second mounting shell 31, which may support the slot 32 to prevent sliding downwards of the slot 32. A lower portion of the boss 33 is connected to a bottom sidewall of the door frame 10. Such a design is beneficial for forming by a mold, and also can increase the structural strength of the boss 33. The slot 32 is elastic, so that it is convenient for butting with the door frame 10.

Of course, it may be understood by those skilled in the art that the detection assembly 12 is not limited to the above-mentioned embodiments, and the detection assembly 12 may also use other implementations. For example, in some embodiments of the disclosure, the detection assembly 12 includes a light generator, a light receiver and a reflecting surface. The light generator and the light receiver are arranged on the door body 11, and the reflecting surface is arranged on the door frame 10. When the door body 11 is in the closed position, the light generator emits light, which is reflected by the reflecting surface and then received by the light receiver. In this case, it may be determined that the door body 11 is in the closed position. When the door body 11 is rotated and opened, the light receiver will be unable to receive the reflected light. In this case, it may be determined that the door body 11 is in the open state. The detection assembly 12 in this embodiment may be used cooperatively with the warning light 18, the buzzer, the speaker and the wireless communication module described in the above embodiments.

The embodiments of the disclosure have been described in detail above with reference to the drawings. However, the disclosure is not limited to the above-mentioned embodiments, and within knowledge of a person of ordinary skill in the art, various changes may be made without departing from the principle of the disclosure.

The invention claimed is:

1. A playpen door, comprising:

a door frame;

a door body movably mounted on the door frame; and a detection assembly mounted on the door frame and the door body and configured to detect open or closed state of the door body, wherein the detection assembly comprises a first mounting shell, a magnet and a sensing unit configured to detect a position of the magnet, one of the magnet and the first mounting shell is mounted on the door frame, the other one of the magnet and the first mounting shell is mounted on the door body, and the first mounting shell has a mounting chamber in which the sensing unit is mounted, wherein a mounting groove is formed on an outer sidewall of the first mounting shell, the mounting groove has a width matched with a thickness of the door body, a through hole is formed in both sidewalls of the mounting groove, a positioning block is arranged in the mounting groove, another through hole is formed on the positioning block, and a bolt passes through the through hole and the another through hole.

2. The playpen door according to claim 1, wherein the detection assembly further comprises a warning light, which is mounted in a third through hole formed in an upper end of the mounting chamber and electrically connected to the sensing unit.

3. The playpen door according to claim 2, wherein the detection assembly further comprises a buzzer electrically connected to the sensing unit, and an inner sidewall of the mounting chamber is formed with a fourth through hole corresponding to the buzzer.

4. The playpen door according to claim 1, wherein the detection assembly further comprises a wireless communication module which is mounted in the mounting chamber and electrically connected to the sensing unit.

5. The playpen door according to claim 2, wherein the mounting chamber is located in a lower portion of the first mounting shell, a switch is arranged on a sidewall of the mounting chamber, an upper portion of the first mounting shell is divided into a battery compartment and a wiring compartment by a spacer that is arranged vertically, the battery compartment is opened or closed by a compartment door, and the first third through hole is located in an upper portion of the wiring compartment.

6. The playpen door according to claim 1, wherein the positioning block is elastic and has a flat surface fitted with the door body.

7. The playpen door according to claim 1, wherein the magnet is mounted in a second mounting shell, a slot is formed in the second mounting shell, the slot is clamped with a vertical sidewall of the door frame, and a boss is arranged on the vertical sidewall of the door frame below the second mounting shell; and a lower portion of the boss is connected to a bottom sidewall of the door frame.

8. The playpen door according to claim 1, wherein the detection assembly comprises a light generator, a light receiver and a reflecting surface, the light generator and the light receiver are arranged on the door body, and the reflecting surface is arranged on the door frame.

9. A playpen door, comprising:

a door frame;

a door body movably mounted on the door frame; and a detection assembly mounted on the door frame and the door body and configured to detect open or closed state of the door body, wherein the detection assembly comprises a first mounting shell, a magnet and a sensing unit configured to detect a position of the magnet, one of the magnet and the first mounting shell is mounted on the door frame, the other one of the magnet and the first mounting shell is mounted on the door body, and the first mounting shell has a mounting chamber in which the sensing unit is mounted, wherein the magnet is mounted in a second mounting shell, a slot is formed in the second mounting shell, the slot is clamped with a vertical sidewall of the door frame, and a boss is arranged on the vertical sidewall of the door frame below the second mounting shell; and a lower portion of the boss is connected to a bottom sidewall of the door frame.

10. The playpen door according to claim 9, wherein the detection assembly further comprises a warning light, which is mounted in a through hole formed in an upper end of the mounting chamber and electrically connected to the sensing unit.

11. The playpen door according to claim 10, wherein the detection assembly further comprises a buzzer electrically connected to the sensing unit, and an inner sidewall of the mounting chamber is formed with another through hole corresponding to the buzzer.

12. The playpen door according to claim 9, wherein the detection assembly further comprises a wireless communication module which is mounted in the mounting chamber and electrically connected to the sensing unit.

13. The playpen door according to claim 10, wherein the mounting chamber is located in a lower portion of the first mounting shell, a switch is arranged on a sidewall of the mounting chamber, an upper portion of the first mounting shell is divided into a battery compartment and a wiring compartment by a spacer that is arranged vertically, the battery compartment is opened or closed by a compartment door, and the through hole is located in an upper portion of the wiring compartment.

14. The playpen door according to claim 11, wherein a mounting groove is formed on an outer sidewall of the first mounting shell, the mounting groove has a width matched with a thickness of the door body, a third through hole is formed in both sidewalls of the mounting groove, a positioning block is arranged in the mounting groove, a fourth through hole is formed on the positioning block, and a bolt passes through the third through hole and the fourth through hole.

15. The playpen door according to claim 9, wherein the detection assembly comprises a light generator, a light receiver and a reflecting surface, the light generator and the light receiver are arranged on the door body, and the reflecting surface is arranged on the door frame.

* * * * *